US008938851B2

(12) United States Patent
Dant et al.

(10) Patent No.: US 8,938,851 B2
(45) Date of Patent: Jan. 27, 2015

(54) NOZZLE ASSEMBLY WITH ONE PIECE BODY

(75) Inventors: Ryan T. Dant, Richmond, KY (US); Eric J. Streciwilk, Danville, KY (US); Richard E. Downey, Danville, KY (US); Shannon D. Phegley, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 324 days.

(21) Appl. No.: 13/166,406

(22) Filed: Jun. 22, 2011

(65) Prior Publication Data

US 2012/0324674 A1 Dec. 27, 2012

(51) Int. Cl.

| | |
|---|---|
| ***A47L 5/26*** | (2006.01) |
| ***A47L 9/28*** | (2006.01) |
| ***A47L 5/30*** | (2006.01) |
| ***A47L 9/04*** | (2006.01) |

(52) U.S. Cl.

CPC ..... *A47L 9/2889* (2013.01); *A47L 5/30* (2013.01); *A47L 9/04* (2013.01); *A47L 9/0411* (2013.01); *A47L 9/281* (2013.01); *A47L 9/2842* (2013.01); *A47L 9/2857* (2013.01)

USPC ..... 15/389; 15/415.1; 15/383

(58) Field of Classification Search

USPC ..... 15/383, 389, 415.1, 334, 377, 391, 392

See application file for complete search history.

(56) References Cited

U.S. PATENT DOCUMENTS

| | | | | |
|---|---|---|---|---|
| 5,539,953 | A | 7/1996 | Kurz | |
| 5,551,120 | A * | 9/1996 | Cipolla et al. | 15/333 |
| 5,983,449 | A * | 11/1999 | Thomas et al. | 15/383 |
| 6,325,864 | B1 | 12/2001 | Zahuranec et al. | |
| 6,438,793 | B1 | 8/2002 | Miner et al. | |
| 7,134,164 | B2 * | 11/2006 | Alton | 15/331 |
| 7,159,271 | B2 | 1/2007 | Sepke et al. | |
| 7,159,277 | B2 | 1/2007 | Steiner et al. | |
| 7,293,326 | B2 * | 11/2007 | Hawkins et al. | 15/389 |
| 7,367,083 | B2 | 5/2008 | Barker et al. | |
| 7,627,927 | B2 * | 12/2009 | Blocker et al. | 15/324 |
| 2003/0145422 | A1 * | 8/2003 | Kaffenberger et al. | 15/377 |
| 2005/0022340 | A1 | 2/2005 | Hafling et al. | |
| 2008/0276409 | A1 | 11/2008 | Sepke et al. | |
| 2009/0083937 | A1 | 4/2009 | Vander Baan | |
| 2009/0113658 | A1 | 5/2009 | Scott et al. | |
| 2009/0265876 | A1 | 10/2009 | Gardner et al. | |
| 2010/0229337 | A1 | 9/2010 | Conrad | |
| 2012/0233806 | A1 * | 9/2012 | Streciwilk | 15/347 |

* cited by examiner

*Primary Examiner* — Dung Van Nguyen

(74) *Attorney, Agent, or Firm* — King & Schickli, PLLC

(57) ABSTRACT

A nozzle assembly for a floor care appliance includes a one-piece body. The one-piece body has a first face and a second face that is opposed to the first face. The first face forms a first cavity while the second face forms a second cavity. A rotary agitator is received in the first cavity. A drive motor is received in the second cavity.

19 Claims, 7 Drawing Sheets

NOZZLE ASSEMBLY WITH ONE PIECE BODY

TECHNICAL FIELD AND INDUSTRIAL APPLICABILITY OF THE INVENTION

The present invention relates generally to the floor care equipment field and, more particularly, to a nozzle assembly incorporating a strong, simple and inexpensive construction.

BACKGROUND OF THE INVENTION

The present invention relates generally to the construction of a nozzle assembly with a one piece body. The nozzle assembly may, for example, comprise the power cleaning head of a canister vacuum cleaner, the nozzle assembly portion of an upright vacuum cleaner or the nozzle assembly of an extractor.

SUMMARY OF THE INVENTION

A nozzle assembly for a floor care appliance comprises a one-piece body including a first face and a second face opposed to the first face. The first face forms a first cavity and the second face forms a second cavity. A rotary agitator is received in the first cavity. A drive motor is received in the second cavity.

A lower plate is received on the body over the first cavity. The lower plate includes an opening and the rotary agitator extends at least partially through that opening. A motor cover is received on the body and encloses the second cavity. In accordance with one aspect of the present invention a bottom wall of the body forms a reverse curve. As a result, the body forms a first portion of a top surface and a second portion of a bottom surface of the nozzle assembly.

In accordance with an additional aspect, an upright vacuum cleaner is provided. The upright vacuum cleaner comprises a body including a nozzle assembly and a handle assembly, a dirt collection vessel carried on the body and a suction generator carried on the body. The upright vacuum cleaner is further characterized by the nozzle assembly including a one-piece body including a first face and a second face opposed to the first face. The first face forms a first cavity and the second face forms a second cavity. A rotary agitator is received in the first cavity while a drive motor is received in the second cavity.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the nozzle assembly and together with the description serve to explain certain principles of the nozzle assembly. In the drawings.

Figure 1:
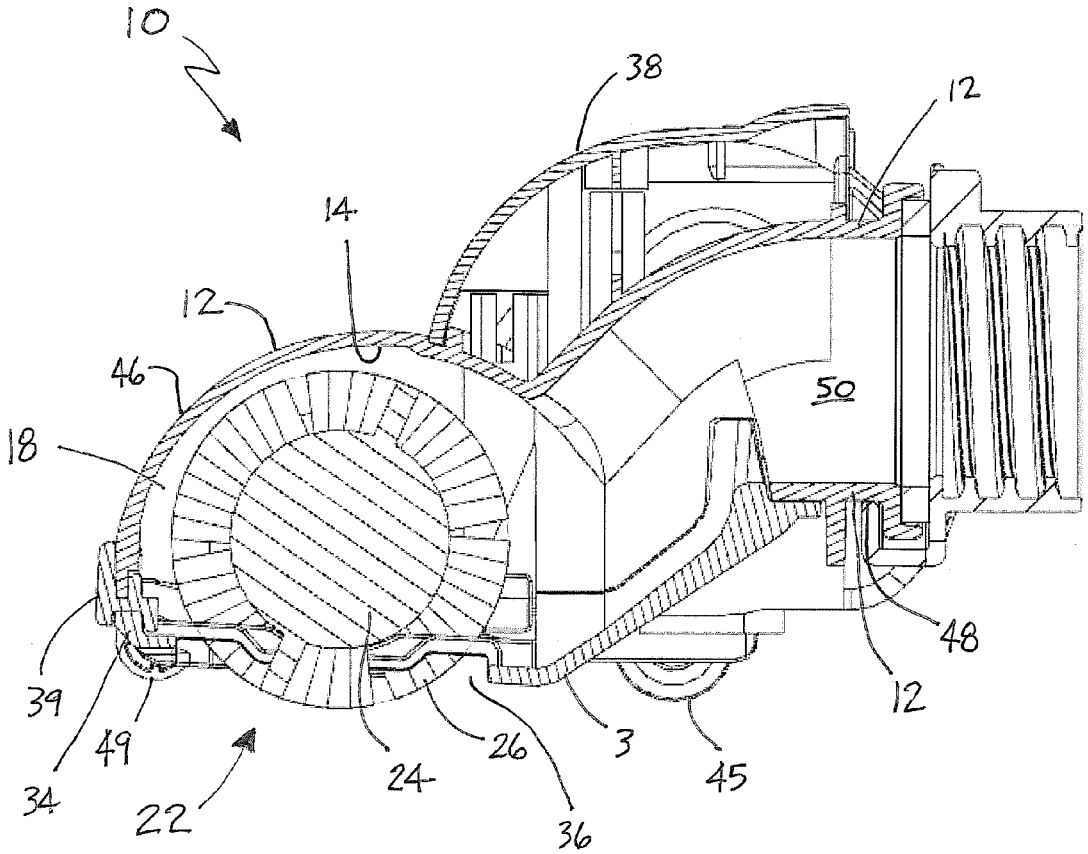
FIG. 1 is a cross sectional view through the nozzle assembly including the rotary agitator and the dirty air conduit.

Reference will now be made in detail to the present preferred embodiment of the nozzle assembly.

DETAILED DESCRIPTION OF THE PREFERRED EMBODIMENTS OF THE INVENTION

Reference is now made to FIGS. 1-6 illustrating the nozzle assembly 10. As illustrated, the nozzle assembly 10 includes a one-piece body 12 having a first face 14 and a second, opposite face 16. A first cavity 18 is formed in the first face 14 while a second cavity 20 is formed in the second face 16. In use the first cavity 18 opens downwardly while the second cavity 20 opens upwardly.

Figure 2:
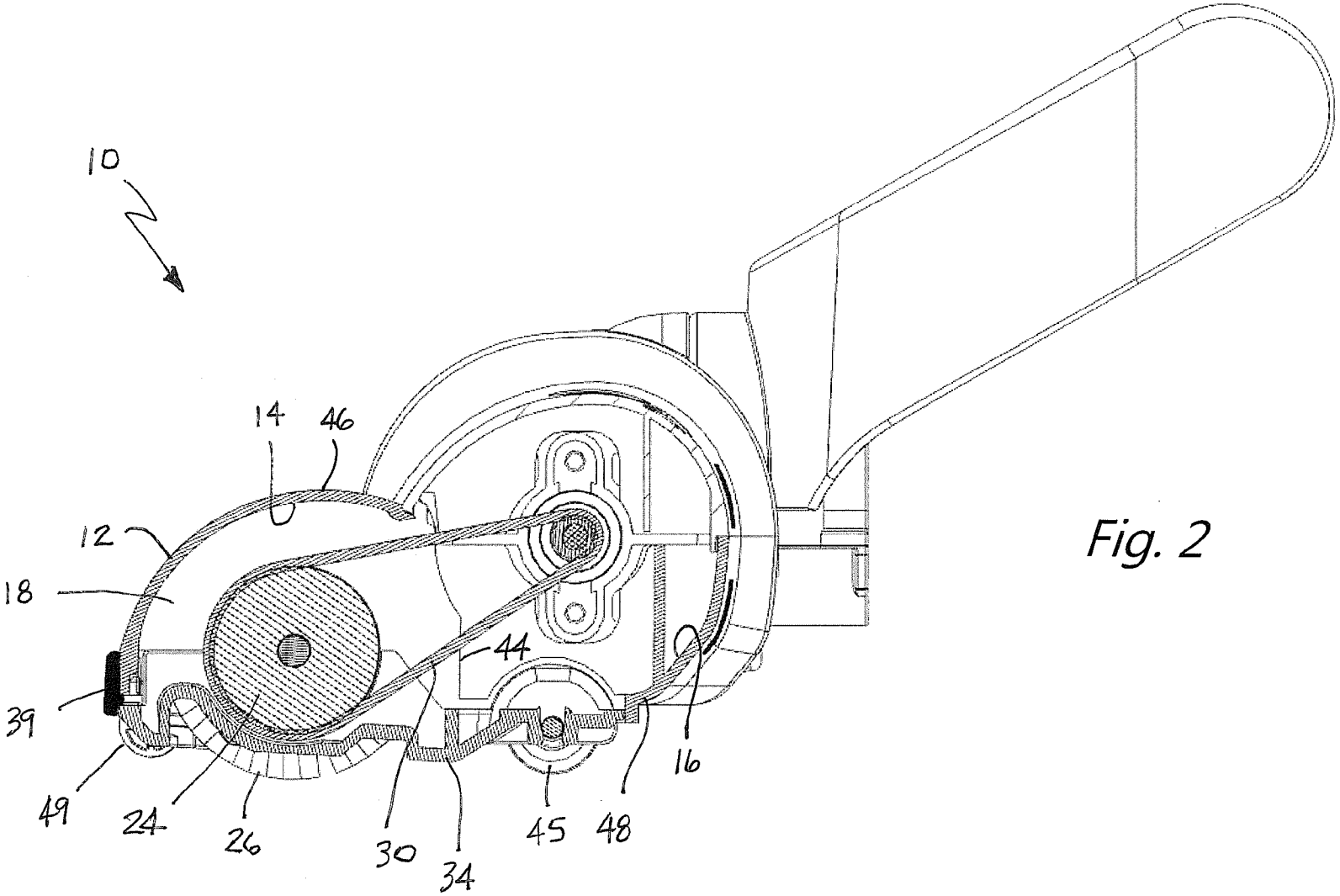
FIG. 2 is a cross sectional view similar to FIG. 1 but taken at a different point so as to show the rotary agitator, the rotary agitator drive motor and the drive belt connecting the two together.
Figure 3:
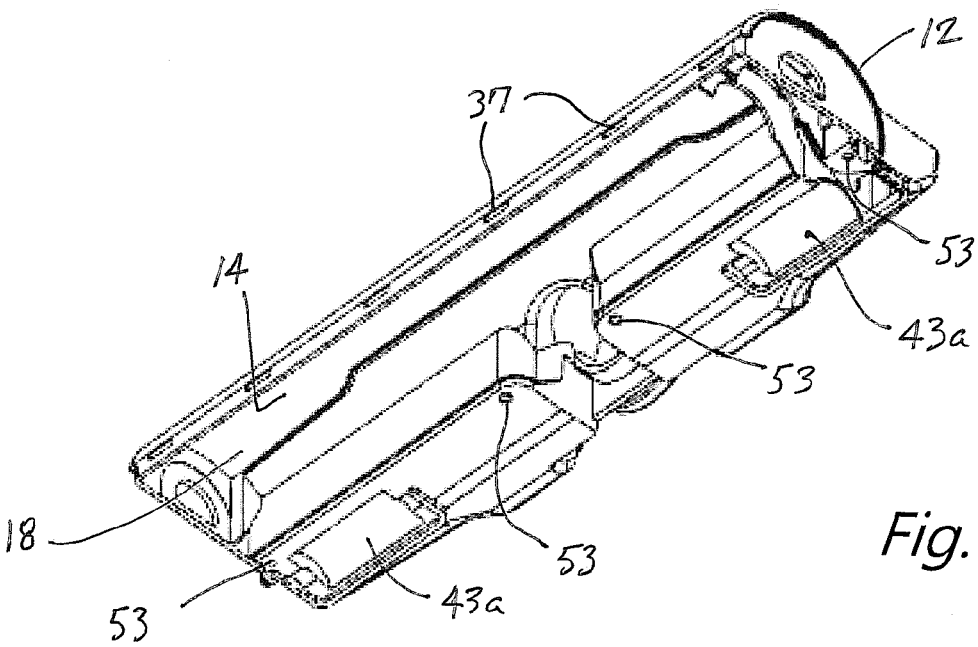
FIG. 3 is a bottom perspective view of the one-piece body of the nozzle assembly.
Figure 4:
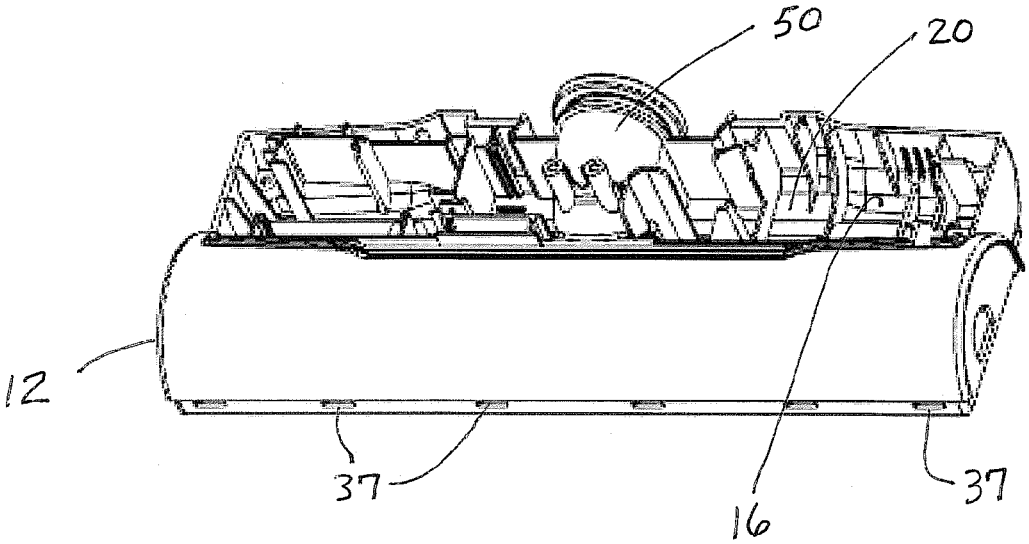
FIG. 4 is a top perspective view of the one-piece body of the nozzle assembly.
Figure 5:
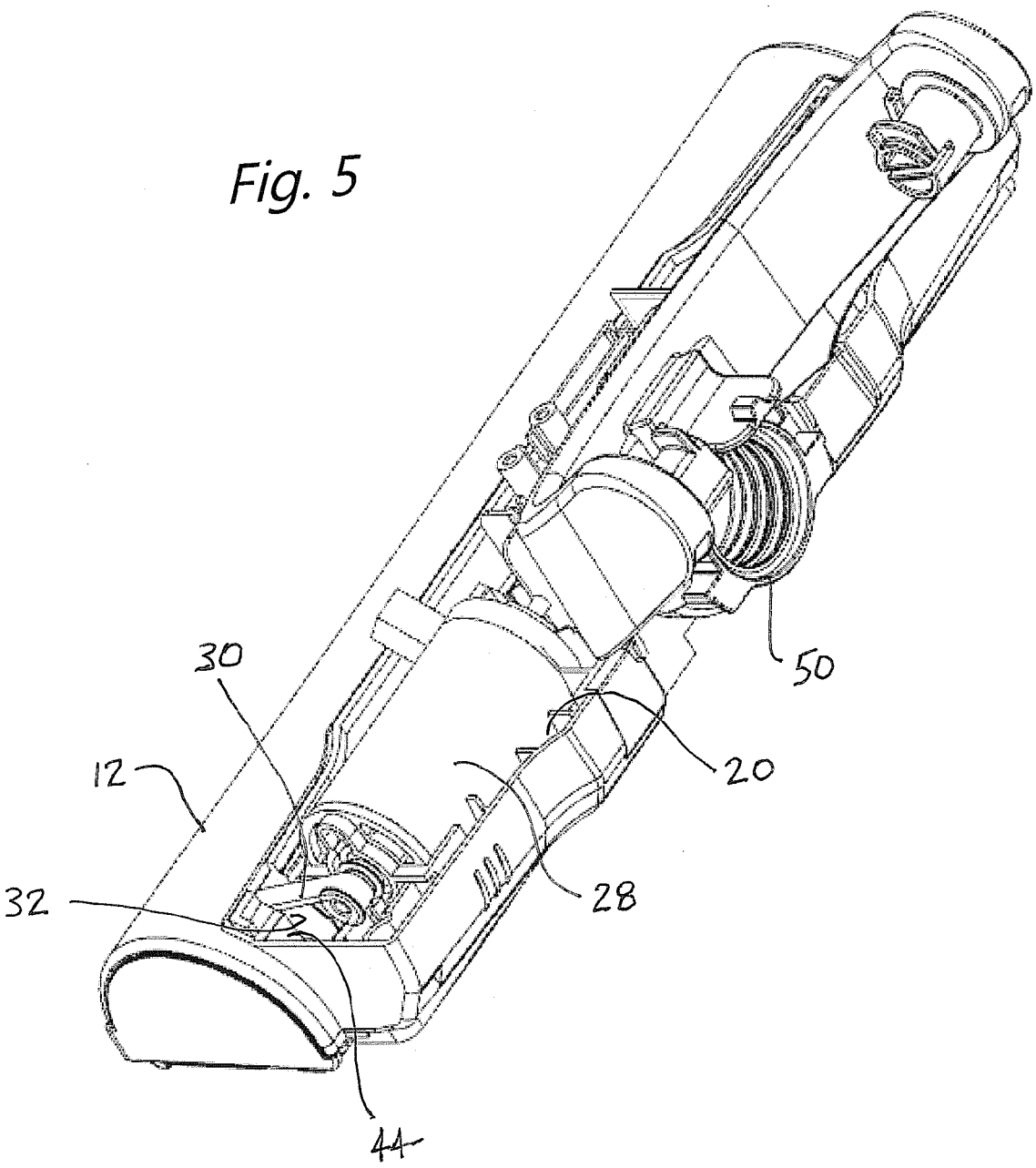
FIG. 5 is a perspective view with the motor cover removed illustrating the drive linkage or belt extending through an opening or slot in the one-piece body and connecting the drive motor with the rotary agitator.
Figure 6:
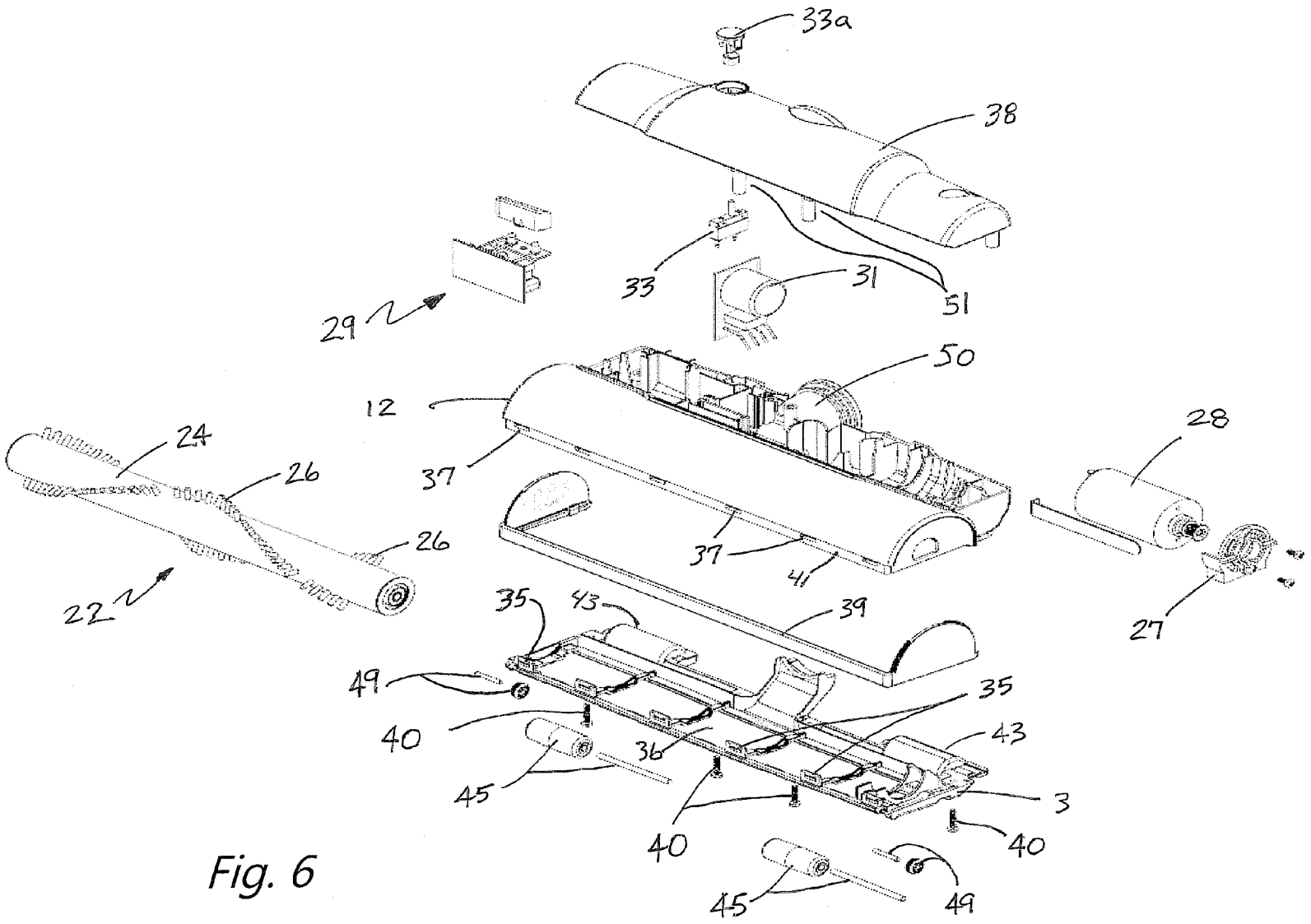
FIG. 6 is an exploded perspective view of the nozzle assembly of FIGS. 1 and 2.

The first cavity 18 functions as an agitator cavity and receives a rotary agitator 22. The rotary agitator 22 comprises a body 24 receiving and holding a series of bristle tufts 26 that project radially from the body in a manner known in the art. As best illustrated in FIGS. 1, 2 and 6, a lower plate 34 is received on the body 12 over the first cavity 18. The lower plate 34 includes an opening 36 and the bristle tufts 26 of the rotary agitator 22 extend at least partially through that opening. A series of resilient tabs 35 are provided along a leading edge of the lower plate. These tabs 35 are received and captured in a series of cooperating slots 37 provided in the body 12. A resilient bumper guard 39 is attached to the body 12 and extends in a channel 41 so as to overlie the slots 37. The lower plate 34 also includes two recesses 43 for receiving the rear roller assemblies 45 and two slots for receiving front wheel assemblies 49. The recesses 43 nest in similar recesses **43*a* provided in the body 12. The roller assemblies 45 and wheel assemblies 49 support the nozzle assembly 10** for free rolling movement across the floor to be cleaned.

The second cavity 20 receives and holds an agitator drive motor 28, cooperating motor support 27, a dirt sensor assembly 29 and electronic circuitry 31 for the drive motor. An overload protector 33 is also contained in the cavity 20. This protector 33 interrupts power to the drive motor 28 in case of an agitator jam so as to protect the agitator drive belt 30. A reset switch **33*a* allows the operator to reset the protector 33 and reestablish power to the drive motor 28 once the agitator is freed for operation. In the illustrated embodiment the drive motor 28 is dedicated to driving the rotary agitator 22 by means of the drive belt 30 that extends through an opening, slot or window 32 in the one-piece body 12 (see particularly FIGS. 2 and 5). As further illustrated in FIGS. 1, 2 and 6-8, a motor cover 38 is received on the body 12 and closes the second cavity 20**.

A series of fasteners 40 secure both the lower plate 34 and motor cover 38 to the body 12. More specifically, the fasteners 40 extend through apertures 53 in the body 12 and engage the bosses 51 on the motor cover 38 with the heads on the fasteners engaging and capturing the lower plate 34. In the illustrated embodiment, the fasteners 40 are screws. It should be appreciated that the fasteners 40 may, however, take substantially any form known to those skilled in the art. For example, the fasteners 40 may comprise quarter turn screws, clips, pins or any combination of fastening structures. The individual fasteners 40 may be of the same or different types.

As should be appreciated from viewing the drawing FIGS. 1-6, the wall 44 of the body 12 forms a reverse or "S" curve so that the body 12 actually forms a first portion 46 of the front and top surface and a second portion 48 of a bottom and rear surface of the nozzle assembly 10. Such a simple construction provides excellent strength at a low cost. In one particularly useful embodiment the body 12 is molded from a translucent material such as polyester, polyethylene terephthalate, polyethylene, high density polyethylene, low density polyethylene, polypropylene, polystyrene, high impact polystyrene, polyamide, acrylonitrile butadiene styrene, polycarbonate, polyurethane, polyvinyl chloride, acrylic, acetal, thermoplastic elastomer and any combinations thereof. Advantageously the rotary agitator 26 in the agitator cavity 18 is visible through the first portion 46 of the body 12 while the drive motor 28 is visible through the second portion 48. This allows the operator to visually inspect the rotary agitator 22 in the first cavity 18 as well as the drive motor 28 and drive belt 30 in the second cavity 20. As should further be appreciated the body 12 includes a dirty air conduit 50 in fluid communication with the first or agitator cavity 18. The translucent body 12 allows visual inspection of the dirty air conduit 50 so that the operator may also check for a clog or the like.

Figure 7:
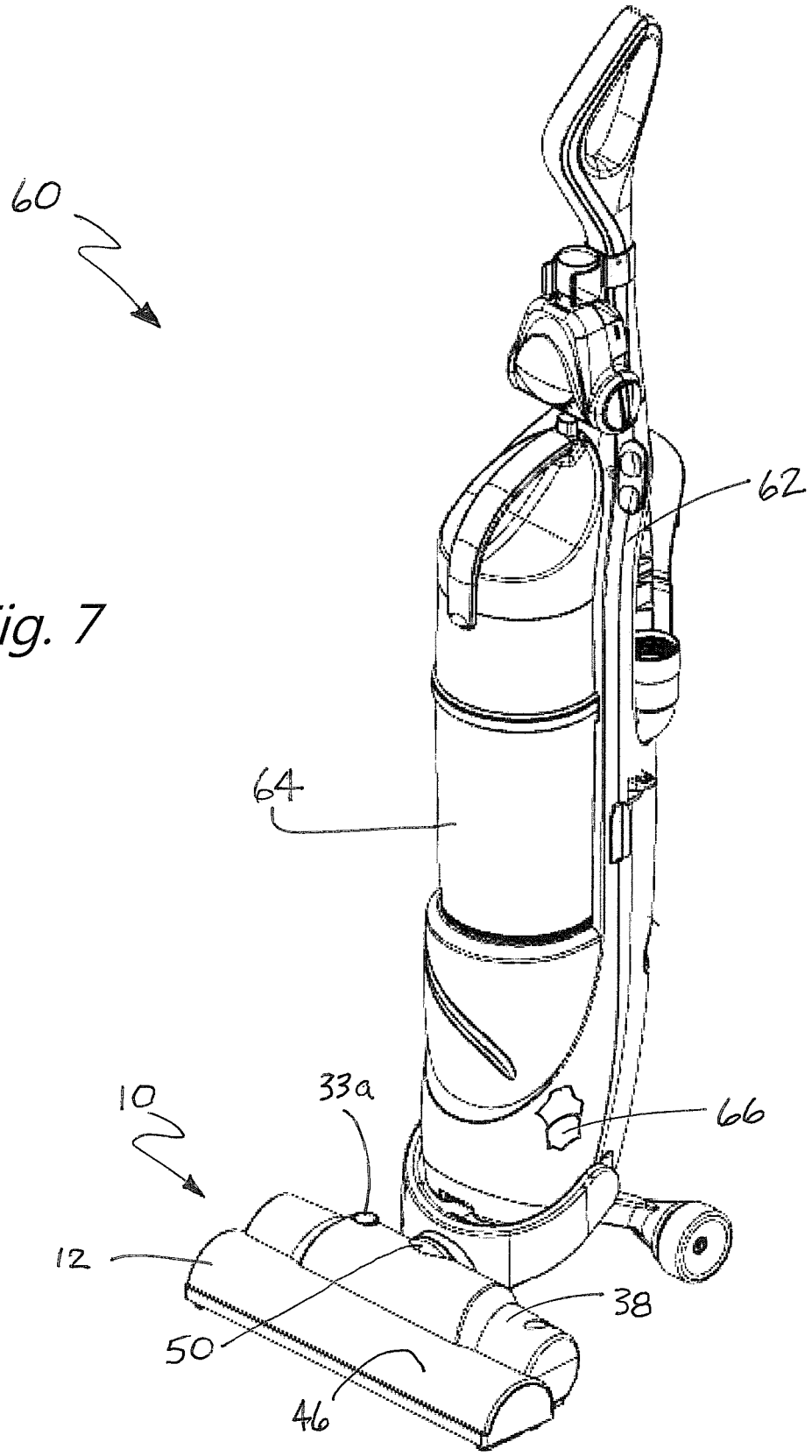
FIG. 7 is a perspective view of an upright vacuum cleaner incorporating a nozzle assembly as described.
Figure 8:
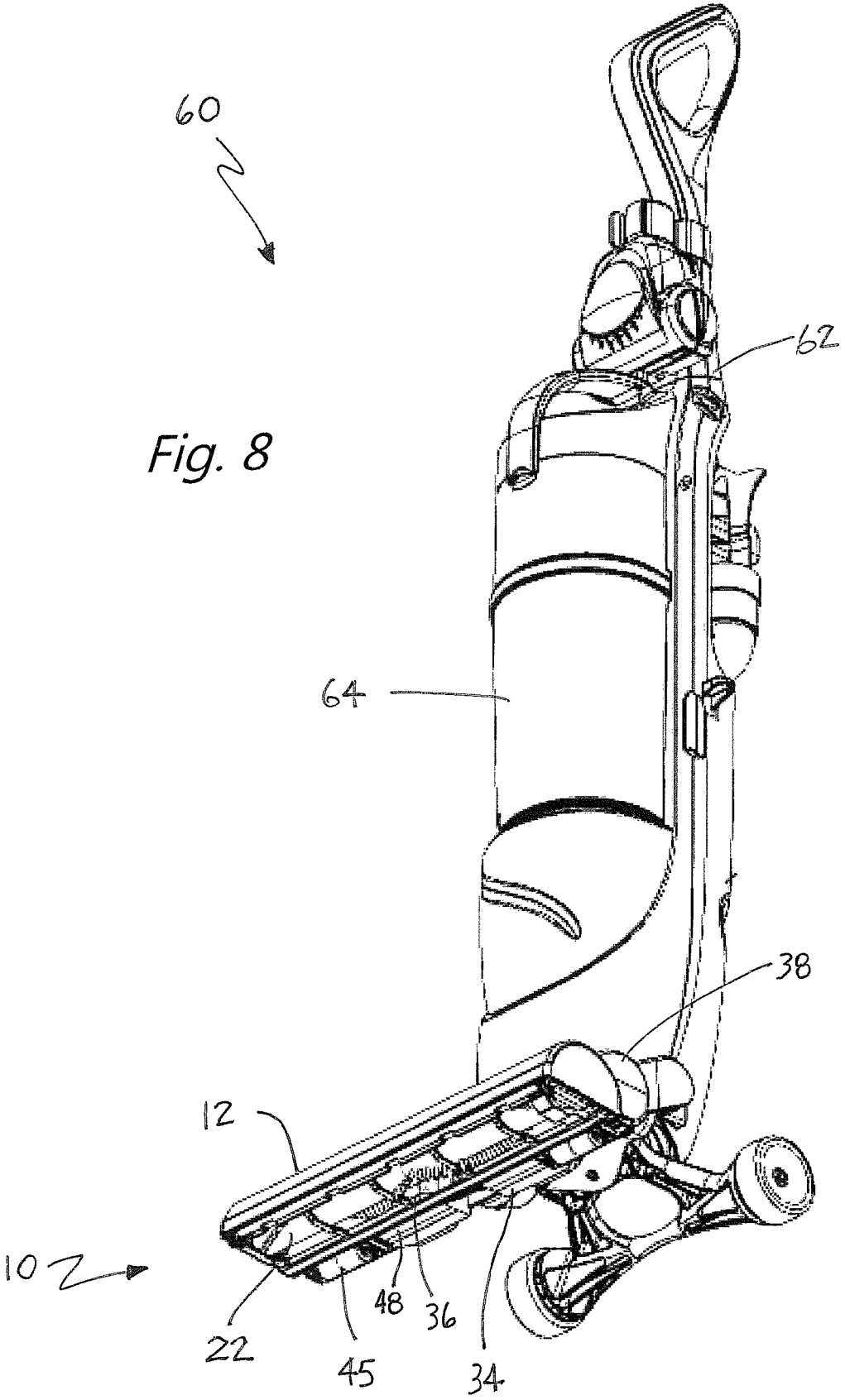
FIG. 8 is a bottom perspective view of the upright vacuum cleaner illustrated in FIG. 7.

Reference is now made to FIGS. 7 and 8 which illustrate an upright vacuum cleaner 60 having a body including the nozzle assembly 10 described in detail above and illustrated in detail in FIGS. 1-6. A handle assembly 62 is pivotally connected to the nozzle assembly 10. A dirt collection vessel 64 is carried on the body and more particularly the handle assembly 62. In the illustrated embodiment the dirt collection vessel 64 comprises a dirt cup with cyclonic cleaning action. It should be appreciated that the dirt collection vessel 64 may take substantially any form including a dirt cup without cyclonic cleaning action or even a state-of-the-art filter or vacuum cleaner bag.

A suction generator 66 is also carried on the body. In the illustrated embodiment the suction generator 66 is carried on the handle assembly 62 in an internal compartment. Thus, in the illustrated embodiment the suction generator 66 is separate from the agitator drive motor 28 carried on the nozzle assembly 10. It should be appreciated that in some upright vacuum cleaner embodiments, a single motor drives the fan of the suction generator and the rotary agitator. For more details respecting the upright vacuum cleaner 60, reference is made to copending U.S. patent application Ser. No. 13/051,613, filed 18 Mar. 2011 and entitled "Vacuum Cleaner with Enhanced Maneuverability", the full disclosure of which is incorporated herein by reference.

The foregoing description of the preferred embodiments of the present invention have been presented for purposes of illustration and description. It is not intended to be exhaustive or to limit the nozzle assembly to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A nozzle assembly for a floor care appliance, comprising:
   - a one piece body including a first face and a second face opposed to said first face, said first face forming a first cavity and said second face forming a second cavity;
   - a rotary agitator received in said first cavity; and
   - a rotary agitator drive motor received and enclosed in said second cavity;
   - said one piece body being further characterized by a wall having a reverse curve forming a first portion of an exposed top surface and a second portion of a bottom surface of said nozzle assembly.

2. The nozzle assembly of claim 1, further including a lower plate received on said body over said first cavity.

3. The nozzle assembly of claim 2, wherein said lower plate includes an opening and said rotary agitator extends at least partially through said opening.

4. The nozzle assembly of claim 2, further including a motor cover received on said body and closing said second cavity.

5. The nozzle assembly of claim 4, including a first fastener securing said lower plate to said body and a second fastener securing said motor cover to said body.

6. The nozzle assembly of claim 5, further including a drive linkage between said drive motor and said rotary agitator, said drive linkage extending through said opening in said body.

7. The nozzle assembly of claim 1, wherein said body includes an opening between said first cavity and said second cavity.

8. The nozzle assembly of claim 1, further including a dirt sensor carried in said second cavity.

9. The nozzle assembly of claim 1, wherein said agitator cavity is visible through said first portion and said drive motor is visible through said second portion.

10. The nozzle assembly of claim 9, wherein said body includes a dirty air conduit in fluid communication with said agitator cavity.

11. The nozzle assembly of claim 10, wherein said translucent body allows visual inspection of an interior of said dirty air conduit.

12. The nozzle assembly of claim 1, wherein said body includes a dirty air conduit in fluid communication with said agitator cavity.

13. The nozzle assembly of claim 12, wherein said body is translucent so as to allow visual inspection of contents in said dirty air conduit and said rotary agitator in said first cavity.

14. An upright vacuum cleaner, comprising:
   - a body including a nozzle assembly and a handle assembly;
   - a dirt collection vessel carried on said body; and
   - a suction generator carried on said handle assembly;
   - said upright vacuum cleaner being characterized by said nozzle assembly including;
   - a one piece body including a first face and a second face opposed to said first face, said first face forming a first cavity and a second portion of a bottom surface of said nozzle assembly said second face forming a second cavity and a first portion of a top surface of said nozzle assembly;

a rotary agitator received in said first cavity; and a rotary agitator drive motor received and enclosed in said second cavity.

15. The vacuum cleaner of claim 14, further including a lower plate received on said body over said first cavity.

16. The vacuum cleaner of claim 15, wherein said lower plate includes an opening and said rotary agitator extends at least partially through said opening.

17. The vacuum cleaner of claim 16, further including a motor cover received on said body and closing said second cavity.

18. The vacuum cleaner of claim 17, wherein said body is made from a translucent material and forms a first portion of a top surface and a second portion of a bottom surface of said nozzle assembly.

19. The vacuum cleaner of claim 18, wherein said handle assembly is pivotally connected to said nozzle assembly.

* * * * *